US005856025A

United States Patent [19]

White et al.

[11] Patent Number: 5,856,025

[45] Date of Patent: *Jan. 5, 1999

[54] METAL MATRIX COMPOSITES

[75] Inventors: Danny R. White, New Castle; Andrew W. Urquhart; Michael K. Aghajanian, both of Newark, all of Del.; Dave K. Creber, Kingston, Canada

[73] Assignee: Lanxide Technology Company, L.P., Newark, Del.

[ * ] Notice: The term of this patent shall not extend beyond the expiration date of Pat. No. 5,395,701.

[21] Appl. No.: 399,306

[22] Filed: Mar. 6, 1995

Related U.S. Application Data

[63] Continuation of Ser. No. 78,146, Jun. 16, 1993, Pat. No. 5,395,701, which is a continuation of Ser. No. 933,609, Aug. 21, 1992, abandoned, which is a continuation of Ser. No. 725,400, Jul. 1, 1991, abandoned, which is a continuation of Ser. No. 504,074, Apr. 3, 1990, abandoned, which is a continuation of Ser. No. 269,251, Nov. 9, 1988, abandoned, which is a continuation of Ser. No. 49,171, May 13, 1987, Pat. No. 4,828,008.

[51] Int. Cl.[6] ..... C22C 1/09; C22C 1/10

[52] U.S. Cl. ..... 428/614; 428/545

[58] Field of Search ..... 428/614, 545, 428/608, 627; 164/97, 98; C22C 1/09, 1/10

[56] References Cited

U.S. PATENT DOCUMENTS

| | | | |
|---|---|---|---|
| 2,951,771 | 9/1960 | Butler | 117/114 |
| 3,031,340 | 4/1962 | Girardot | 117/118 |
| 3,149,409 | 9/1964 | Maruhn | 29/156.5 |
| 3,364,976 | 1/1968 | Reding et al. | 164/63 |
| 3,547,180 | 12/1970 | Cochran et al. | 164/61 |
| 3,608,170 | 9/1971 | Larson et al. | 29/149.9 |
| 3,718,441 | 2/1973 | Landingham | 29/182.1 |
| 3,728,108 | 4/1973 | Sifferlen et al. | 428/614 |
| 3,729,794 | 5/1973 | Douglass | 428/606 |
| 3,864,154 | 2/1975 | Gazza et al. | 29/123 B |
| 3,868,267 | 2/1975 | Gazza et al. | 264/60 X |
| 3,890,690 | 6/1975 | Li | 428/614 |
| 3,969,553 | 7/1976 | Kondo et al. | 427/299 |
| 3,970,136 | 7/1976 | Cannell et al. | 164/108 |
| 4,033,400 | 7/1977 | Gurwell et al. | 164/98 |
| 4,082,864 | 4/1978 | Kendall et al. | 427/248 |
| 4,134,759 | 1/1979 | Yajima et al. | 428/614 |
| 4,232,091 | 11/1980 | Grimshaw et al. | 428/472 |
| 4,244,751 | 1/1981 | Hioki et al. | 148/222 |
| 4,376,803 | 3/1983 | Katzman | 428/408 |
| 4,376,804 | 3/1983 | Katzman | 428/408 |
| 4,377,196 | 3/1983 | Khondros | 164/66.1 |
| 4,404,262 | 9/1983 | Watmough | 428/539.5 |
| 4,450,207 | 5/1984 | Donomoto et al. | 428/614 |
| 4,473,103 | 9/1984 | Kenney et al. | 164/97 |
| 4,548,253 | 10/1985 | Funatani et al. | 164/97 |
| 4,570,316 | 2/1986 | Sakamaki et al. | 29/156.8 R |
| 4,587,177 | 5/1986 | Toaz et al. | 428/614 |
| 4,600,481 | 7/1986 | Sane et al. | 204/67 |
| 4,630,665 | 12/1986 | Novak | 164/97 |
| 4,657,065 | 4/1987 | Wada et al. | 148/11.5 A |
| 4,662,429 | 5/1987 | Wada et al. | 164/461 |
| 4,673,435 | 6/1987 | Yamaguchi et al. | 75/235 |
| 4,679,493 | 7/1987 | Munro et al. | 92/212 |
| 4,713,111 | 12/1987 | Cameron et al. | 75/68 R |
| 4,713,360 | 12/1987 | Newkirk et al. | 501/87 |
| 4,731,298 | 3/1988 | Shindo et al. | 428/611 |
| 4,753,690 | 6/1988 | Wada et al. | 168/461 |
| 4,759,995 | 7/1988 | Skibo et al. | 428/614 |
| 4,777,014 | 10/1988 | Newkirk et al. | 419/12 |
| 4,824,625 | 4/1989 | Claar et al. | 264/126 |
| 4,828,008 | 5/1989 | White et al. | 164/97 |
| 4,851,375 | 7/1989 | Newkirk et al. | 501/88 |
| 4,935,055 | 6/1990 | Aghajanian et al. | 428/614 |
| 4,985,382 | 1/1991 | Nadkarni et al. | 501/155 |
| 5,028,392 | 7/1991 | Lloyd et al. | 420/528 |

FOREIGN PATENT DOCUMENTS

| | | |
|---|---|---|
| 0094353 | 11/1983 | European Pat. Off. . |
| 0106108 | 4/1984 | European Pat. Off. . |
| 0115742 | 8/1984 | European Pat. Off. . |
| 2819076 | 10/1979 | Germany . |
| 144441 | 8/1983 | Japan . |
| 2156718 | 4/1984 | United Kingdom . |

OTHER PUBLICATIONS

"Handbook of Chemistry and Physics", 52nd edition, 1971 (no month) pp. B64, B74 & B150.

F. Delannay, L. Froyen, and A. Deruyttere, "Review: The Wetting of Solids by Molten Metals and Its Relation to the Preparation of Metal–Matrix Composites", Journal of Materials Science, vol. 22, No. 1, pp. 1–16, Jan. 1987.

G. R. Edwards and D. L. Olson, "The Infiltration Kinetics of Aluminum in Silicon Carbide Compacts", Annual Report from Center for Welding Research, Colorado School of Mines, under ONR Contract No. M00014–85–K–0451, DTIC Report AD–A184, Jul. 1987.

A. Mortensen, M. N. Gungor, J. A. Cornie and M.C. Flemings "Alloy Microstructures in Cast Metal Matrix Composites", Journal of Metals, vol. 38, No. 3, pp. 30–35, Mar. 1986.

Stanislav Kudela and Augustin Schweighofer, "Study of Nitridation Process of Aluminum–Magnesium Alloys", Kovove Materialy 6,17—Bratislava (1979), pp. 724–736. (no month).

A.Schweighofer et al. "Production of Dispersion Hardened Aluminum with a High Pressure Autoclave," Chem. Abs. 81:125546, 1974, 1 page.

*Primary Examiner*—Ngoc-Yen Nguyen
*Attorney, Agent, or Firm*—Jeffrey R. Ramberg

[57] ABSTRACT

A ceramic-reinforced aluminum matrix composite is formed by contacting a molten aluminum-magnesium alloy with a permeable mass of ceramic material in the presence of a gas comprising from about 10 to 100% nitrogen, by volume, balance non-oxidizing gas, e.g., hydrogen or argon. Under these conditions, the molten alloy spontaneously infiltrates the ceramic mass under normal atmospheric pressures. A solid body of the alloy can be placed adjacent a permeable bedding of ceramic material, and brought to the molten state, preferably to at least about 700° C., in order to form the aluminum matrix composite by infiltration. In addition to magnesium, auxiliary alloying elements may be employed with aluminum. The resulting composite products may contain a discontinuous aluminum nitride phase in the aluminum matrix and/or an aluminum nitride external surface layer.

16 Claims, 2 Drawing Sheets

METAL MATRIX COMPOSITES

This is a continuation of application(s) Ser. No. 08/078,146 filed on Jun. 16, 1993 which issued Mar. 7, 1995, as U.S. Pat. No. 5,395,701, which was a continuation of U.S. Ser. No. 07/933,609, filed Aug. 21, 1992, and now abandoned, which was a continuation of U.S. Ser. No. 07/725,400, filed Jul. 1, 1991, and now abandoned, which was a continuation of U.S. Ser. No. 07/504,074, filed Apr. 3, 1990, and now abandoned, which was a continuation of U.S. Ser. No. 07/269,251, filed Nov. 9, 1988, and now abandoned, which was a continuation of U.S. Ser. No. 07/049,171, filed May 13, 1987, which issued on May 9, 1989, as U.S. Pat. No. 4,828,008.

BACKGROUND OF THE INVENTION

1. Field of the Invention

The present invention relates to a method of making a metal matrix composite by the spontaneous infiltration of a permeable mass of ceramic filler material with a molten metal, and, more particularly, with a molten aluminum alloy in the presence of nitrogen. The invention relates also to aluminum matrix composites made by the method.

2. Description of the Prior Art

Composite products comprising a metal matrix and a strengthening or reinforcing phase such as ceramic particulates, whiskers, fibers or the like, show great promise for a variety of applications because they combine the strength and hardness of the strengthening phase with the ductility and toughness of the metal matrix. Generally, a metal matrix composite will show an improvement in such properties as strength, stiffness, contact wear resistance, and elevated temperature strength retention relative to the matrix metal, per se, but the degree to which any given property may be improved depends largely on the specific constituents, their volume or weight fraction, and how they are processed in forming the composite. In some instances, the composite also may be lighter in weight. Aluminum matrix composites reinforced with ceramics such as silicon carbide in particulate, platelet, or whisker form, for example, are of interest because of their higher stiffness, wear resistance and high temperature strength relative to aluminum.

Various metallurgical processes have been described for the fabrication of aluminum matrix composites, ranging from methods based on powder metallurgy techniques to those involving liquid-metal infiltration such as by pressure casting. With powder metallurgy techniques, the metal in the form of a powder and the reinforcing material in the form of a powder, whiskers, chopped fibers, etc., are admixed and then either cold-pressed and sintered, or hot-pressed. The maximum ceramic volume fraction in silicon carbide reinforced aluminum matrix composites produced by this method has been reported to be 25 volume percent in the case of whiskers, and 40 volume percent in the case of particulates.

The production of metal matrix composites by powder metallurgy utilizing conventional processes imposes certain limitations with respect to the characteristics of the products attainable. The volume fraction of the ceramic phase in the composite is limited typically to about 40 percent. Also, the pressing operation poses a limit on the practical size attainable. Only relatively simple product shapes are possible without subsequent processing (e.g., forming or machining) or without resorting to complex presses. Also, nonuniform shrinkage during sintering can occur, as well as nonuniformity of micro-structure due to segregation in the compacts and grain growth.

U.S. Pat. No. 3,970,136, granted Jul. 20, 1976, to J. C. Cannell et al., describes a process for forming a metal matrix composite incorporating a fibrous reinforcement, e.g. silicon carbide or alumina whiskers, having a predetermined pattern of fiber orientation. The composite is made by placing parallel mats or felts of coplanar fibers in a mold with a reservoir of molten matrix metal, e.g., aluminum, between at least some of the mats, and applying pressure to force molten metal to penetrate the mats and surround the oriented fibers. Molten metal may be poured onto the stack of mats while being forced under pressure to flow between the mats. Loadings of up to about 50% by volume of reinforcing fiber in the composite have been reported.

The above-described infiltration process, in view of its dependence on outside pressure to force the molten matrix metal through the stack of fibrous mats, is subject to the vagaries of pressure-induced flow processes, i.e. possible non-uniformity of matrix formation, porosity, etc. Non-uniformity of properties is possible even though molten metal may be introduced at a multiplicity of sites within the fibrous array. Consequently, complicated mat/reservoir arrays and flow pathways need to be provided to achieve adequate and uniform penetration of the stack of fiber mats. Also, the aforesaid pressure-infiltration method allows for only a relatively low reinforcement to matrix volume fraction to be achieved because of difficulty of infiltrating a large mat volume. Still further, molds are required to contain the molten metal under pressure, which adds to the expense of the process. Finally, the aforesaid process, limited to infiltrating aligned particles or fibers, is not directed to formation of aluminum metal matrix composites reinforced with materials in the form of randomly oriented particles, whiskers or fibers.

In the fabrication of aluminum matrix-alumina filled composites, aluminum does not readily wet alumina, thereby making it difficult to form a coherent product. The prior art suggests various solutions to this problem. One such approach is to coat the alumina with a volatile metal (e.g., nickel or tungsten), which is then hot-pressed along with the aluminum. In another technique, the aluminum is alloyed with lithium, and the alumina may be coated with silica. However, these composites exhibit variations in properties, or the coatings can degrade the filler, or the matrix contains lithium which can affect the metal properties.

U.S. Pat. No. 4,232,091 to R. W. Grimshaw et al., overcomes certain difficulties of the prior art in the production of aluminum matrix-alumina composites. This patent describes applying pressures of 75–375 kg/cm$^2$ to force aluminum (or aluminum alloy) into a fibrous or whisker mat of alumina which has been preheated to 700 ° to 1050° C. The maximum volume ratio of alumina to metal in the resulting solid casting was 0.25/1. Because of its dependency on outside force to accomplish infiltration, this process is subject to many of the same deficiencies as that of Cannell et al.

European Patent Application Publication No. 115,742 describes making aluminum-alumina composites, especially useful as electrolytic cell components, by filling the voids of a preformed alumina matrix with molten aluminum. The application emphasizes the non-wettability of alumina by aluminum, and therefore various techniques are employed to wet the alumina throughout the preform. For example, the alumina is coated with a wetting agent of a diboride of titanium, zirconium, hafnium, or niobium, or with a metal, i.e., lithium, magnesium, calcium, titanium, chromium, iron, cobalt, nickel, zirconium, or hafnium. Inert atmospheres, such as argon, are employed to facilitate wetting and infiltration. This reference also shows applying pressure to cause molten aluminum to penetrate an uncoated preform. In this aspect, infiltration is accomplished by evacuating the pores and then applying pressure to the molten aluminum in an inert atmosphere, e.g., argon. Alternatively, the preform can be infiltrated by vapor-phase aluminum deposition to wet the surface prior to filling the voids by infiltration with molten aluminum. To assure retention of the aluminum in the pores of the preform, heat treatment, e.g., at 1400° to 1800° C., in either a vacuum or in argon is required. Otherwise, either exposure of the pressure infiltrated material to gas or removal of the infiltration pressure will cause loss of aluminum from the body.

The use of wetting agents to effect infiltration of an alumina component in an electrolytic cell with molten metal is also shown in European Patent Application Publication No. 94353. This publication describes production of aluminum by electrowinning with a cell having a cathodic current feeder as a cell liner or substrate. In order to protect this substrate from molten cryolite, a thin coating of a mixture of a wetting agent and solubility suppressor is applied to the alumina substrate prior to start-up of the cell or while immersed in the molten aluminum produced by the electrolytic process. Wetting agents disclosed are titanium, zirconium, hafnium, silicon, magnesium, vanadium, chromium, niobium, or calcium, and titanium is stated as the preferred agent. Compounds of boron, carbon and nitrogen are described as being useful in suppressing the solubility of the wetting agents in molten aluminum. The reference, however, does not suggest the production of metal matrix composites, nor does it suggest the formation of such a composite in a nitrogen atmosphere.

In addition to application of pressure and wetting agents, it has been disclosed that an applied vacuum will aid the penetration of molten aluminum into a porous ceramic compact. For example, U.S. Pat. No. 3,718,441, granted Feb. 27, 1973, to R. L. Landingham, reports infiltration of a ceramic compact (e.g., boron carbide, alumina and beryllia) with either molten aluminum, beryllium, magnesium, titanium, vanadium, nickel or chromium under a vacuum of less than $10^{-6}$ torr. A vacuum of $10^{-2}$ to $10^{-6}$ torr resulted in poor wetting of the ceramic by the molten metal to the extent that the metal did not flow freely into the ceramic void spaces. However, wetting was said to have improved when the vacuum was reduced to less than $10^{-6}$ torr.

U.S. Pat. No. 3,864,154, granted Feb. 4, 1975, to G. E. Gazza et al., also shows the use of vacuum to achieve infiltration. This patent describes loading a cold-pressed compact of $AlB_{12}$ powder onto a bed of cold-pressed aluminum powder. Additional aluminum was then positioned on top of the $AlB_{12}$ powder compact. The crucible, loaded with the $AlB_{12}$ compact "sandwiched" between the layers of aluminum powder, was placed in a vacuum furnace. The furnace was evacuated to approximately $10^{-5}$ torr to permit outgassing. The temperature was subsequently raised to 1100° C. and maintained for a period of 3 hours. At these conditions, the molten aluminum penetrated the porous $AlB_{12}$ compact.

As shown above, the prior art relies on the use of applied pressure, vacuum, or wetting agents to effect infiltration of metal into a ceramic mass. None of the art cited discusses or suggests spontaneous infiltration of ceramic material with molten aluminum alloys under atmospheric pressure.

SUMMARY OF THE INVENTION

The present method comprises producing a metal matrix composite by infiltrating a permeable mass of ceramic filler or ceramic coated filler with molten aluminum containing at least about 1% by weight magnesium, and preferably at least about 3% by weight. Infiltration occurs spontaneously without the need of external pressure or high vacuum. A supply of the molten metal alloy is contacted with the mass of filler material at a temperature of at least about 700° C. in the presence of a gas comprising from about 10 to 100%, and preferably at least about 50%, nitrogen by volume, balance non-oxidizing gas, e.g., argon. Under these conditions, the molten aluminum alloy infiltrates the ceramic mass under normal atmospheric pressures to form an aluminum matrix composite. When the desired amount of ceramic material has been infiltrated with molten alloy, the temperature is lowered to solidify the alloy, thereby forming a solid metal matrix structure that embeds the reinforcing ceramic material. Usually, and preferably, the supply of molten alloy delivered will be sufficient to allow the infiltration to proceed essentially to the boundaries of the ceramic mass. The amount of ceramic filler in the aluminum matrix composites produced according to the invention may be exceedingly high. In this respect, filler to alloy ratios of greater than 1:1 may be achieved.

In one embodiment, a supply of molten aluminum alloy is delivered to the ceramic mass by positioning a body of the alloy adjacent to or in contact with a permeable bed of the ceramic filler material. The alloy and bed are exposed to the nitrogen-containing gas at a temperature above the alloy's melting point, in the absence of applied pressure or vacuum, whereby the molten alloy spontaneously infiltrates the adjacent or surrounding bed. Upon reduction of the temperature to below the alloy's melting point, a solid matrix of aluminum alloy embedding the ceramic is obtained. It should be understood that a solid body of the aluminum alloy may be positioned adjacent the mass of filler, and the metal is then melted and allowed to infiltrate the mass, or the alloy may be melted separately and then poured against the mass of filler.

The aluminum matrix composites produced according to the present invention typically contain aluminum nitride in the aluminum matrix as a discontinuous phase. The amount of nitride in the aluminum matrix may vary depending on such factors as the choice of temperature, alloy composition, gas composition and ceramic filler. The discontinuous aluminum nitride phase is dispersed throughout the aluminum matrix of the composite. Further, this discontinuous aluminum nitride phase is present in at least two separately identifiable and physically distinct forms: (1) a coating or surface layer covering at least a portion of the ceramic filler; and (2) discrete, discontinuous bodies contacted by only the aluminum matrix metal. Still further, if elevated temperature exposure in the nitriding atmosphere is continued after infiltration is complete, aluminum nitride may form on the exposed surfaces of the composite. The amount of dispersed aluminum nitride as well as the depth of nitridation along the outer surfaces may be varied by controlling one or more factors in the system, e.g. temperature, thereby making it possible to tailor certain properties of the composite or to provide an aluminum matrix composite with an aluminum nitride skin as a wear surface, for example.

The expression "balance non-oxidizing gas", as used herein denotes that any gas present in addition to elemental nitrogen is either an inert gas or reducing gas which is substantially nonreactive with the aluminum under the process conditions. Any oxidizing gas (other than nitrogen) which may be present as an impurity in the gas(es) used, is insufficient to oxidize the metal to any substantial extent.

It should be understood that the terms "ceramic", "ceramic material", "ceramic filler" or "ceramic filler material" are intended to include ceramic fillers, per se, such as alumina or silicon carbide fibers, and ceramic coated filler materials such as carbon fibers coated with alumina or silicon carbide to protect the carbon from attack by molten metal. Further, it should be understood that the aluminum used in the process, in addition to being alloyed with magnesium, may be essentially pure or commercially pure aluminum, or may be alloyed with other constituents such as iron, silicon, copper, manganese, chromium, and the like.

BRIEF DESCRIPTION OF THE DRAWINGS

In the accompanying drawings, which illustrate the microstructures of aluminum matrix composites made according to the method of the invention.

DETAILED DESCRIPTION

Figure 1:
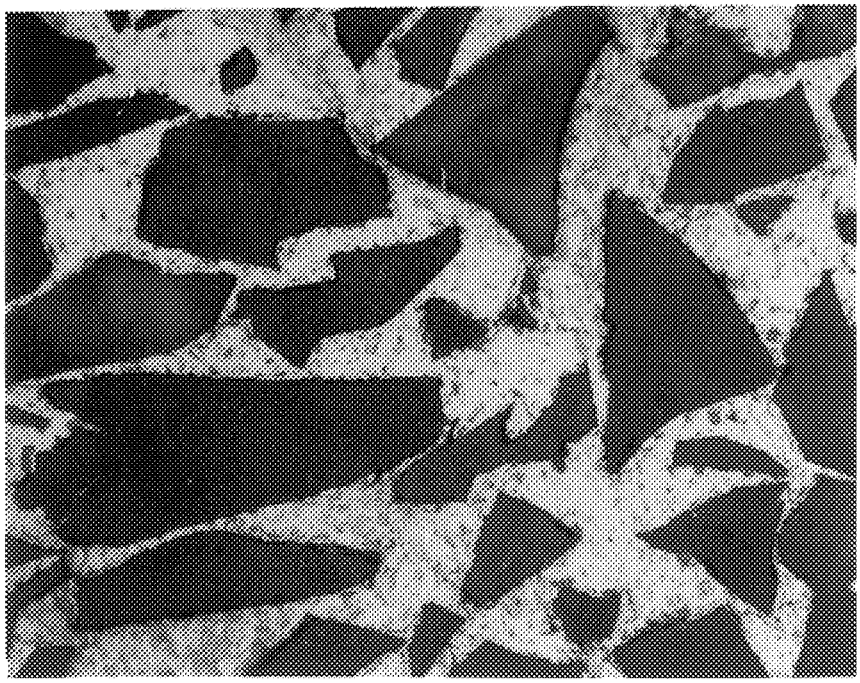
FIG. 1 is a photomicrograph taken at 400X magnification of an alumina-reinforced aluminum matrix composite produced at 850° C. substantially in accordance with Example 3.

In accordance with the method of this invention, an aluminum-magnesium alloy in the molten state is contacted with or delivered to a surface of a permeable mass of ceramic material, e.g., ceramic particles, whiskers or fibers, in the presence of a nitrogen-containing gas, and the molten aluminum alloy spontaneously and progressively infiltrates the permeable ceramic mass. The extent of spontaneous infiltration and formation of the metal matrix will vary with the process conditions, as explained below in greater detail. Spontaneous infiltration of the alloy into the mass of ceramic results in a composite product in which the aluminum alloy matrix embeds the ceramic material.

According to co-assigned U.S. patent application Ser. No. 818,943, filed Jan. 15, 1986, now U.S. Pat. No. 4,713,360, by M. S. Newkirk et al., it had previously been found that aluminum nitride forms on, and grows from, the free surface of a body of molten aluminum alloy when the latter is exposed to a nitriding atmosphere, e.g., forming gas (a 96/4 nitrogen/hydrogen mixture, by volume). Moreover, according to co-assigned U.S. patent application Ser. No. 819,397, filed Jan. 17, 1986, now U.S. Pat. No. 4,851,375, by M. S. Newkirk et al., a matrix structure of interconnected aluminum nitride crystallites had been found to form within a porous mass of filler particles permeated with forming gas when the mass was maintained in contact with a molten aluminum alloy. Therefore, it was surprising to find that, in a nitriding atmosphere, a molten aluminum-magnesium alloy spontaneously infiltrates a permeable mass of ceramic material to form a metal matrix composite.

Under the conditions employed in the method of the present invention, the ceramic mass or body is sufficiently permeable to allow the gaseous nitrogen to penetrate the body and contact the molten metal and to accommodate the infiltration of molten metal, whereby the nitrogen-permeated ceramic material is spontaneously infiltrated with molten aluminum alloy to form an aluminum matrix composite. The extent of spontaneous infiltration and formation of the metal matrix will vary with a given set of process conditions, i.e., magnesium content of the aluminum alloy, presence of additional alloying elements, size, surface condition and type of filler material, nitrogen concentration of the gas, time and temperature. For infiltration of molten aluminum to occur spontaneously, the aluminum is alloyed with at least about 1%, and preferably at least about 3%, magnesium, based on alloy weight. One or more auxiliary alloying elements, e.g. silicon, zinc, or iron, may be included in the alloy, which may affect the minimum amount of magnesium that can be used in the alloy. It is known that certain elements can volatilize from a melt of aluminum, which is time and temperature dependent, and therefore during the process of this invention, volatilization of magnesium, as well as zinc, can occur. It is desirable, therefore, to employ an alloy initially containing at least about 1% by weight magnesium. The process is conducted in the presence of a nitrogen atmosphere containing at least about 10 volume percent nitrogen and the balance a non-oxidizing gas under the process conditions. After the substantially complete infiltration of the ceramic mass, the metal is solidified as by cooling in the nitrogen atmosphere, thereby forming a solid metal matrix essentially embedding the ceramic filler material. Because the aluminum-magnesium alloy wets the ceramic, a good bond is to be expected between the metal and the ceramic, which in turn may result in improved properties of the composite.

The minimum magnesium content of the aluminum alloy useful in producing a ceramic filled metal matrix composite depends on one or more variables such as the processing temperature, time, the presence of auxiliary alloying elements such as silicon or zinc, the nature of the ceramic filler material, and the nitrogen content of the gas stream. Lower temperatures or shorter heating times can be used as the magnesium content of the alloy is increased. Also, for a given magnesium content, the addition of certain auxiliary alloying elements such as zinc permits the use of lower temperatures. For example, a magnesium content at the lower end of the operable range, e.g.. from about 1 to 3 weight percent, may be used in conjunction with at least one of the following: an above-minimum processing temperature, a high nitrogen concentration, or one or more auxiliary alloying elements. Alloys containing from about 3 to 5 weight percent magnesium are preferred on the basis of their general utility over a wide variety of process conditions, with at least about 5% being preferred when lower temperatures and shorter times are employed. Magnesium contents in excess of about 10% by weight of the aluminum alloy may be employed to moderate the temperature conditions required for infiltration. The magnesium content may be reduced when used in conjunction with an auxiliary alloying element, but these elements serve an auxiliary function only and are used together with the above-specified amount of magnesium. For example, there was substantially no infiltration of nominally pure aluminum alloyed only with 10% silicon at 1000° C. into a bedding of 500 mesh, 39 Crystolon (99% pure silicon carbide from Norton Co.).

The use of one or more auxiliary alloying elements and the concentration of nitrogen in the surrounding gas also affects the extent of nitriding of the alloy matrix at a given temperature. For example, increasing the concentration of an auxiliary alloying element such as zinc or iron in the alloy may be used to reduce the infiltration temperature and thereby decrease the nitride formation, whereas increasing the concentration of nitrogen in the gas may be used to promote nitride formation.

The concentration of magnesium in the alloy also tends to affect the extent of infiltration at a given temperature. Consequently, it is preferred that at least about three weight percent magnesium be included in the alloy. Alloy contents of less than this amount, such as one weight percent magnesium, tend to require higher process temperatures or an auxiliary alloying element for infiltration. The temperature required to effect the spontaneous infiltration process of this invention may be lower when the magnesium content of the alloy is increased, e.g. to at least about 5 weight percent, or when another element such as zinc or iron is present in the aluminum alloy. The temperature also may vary with different ceramic materials. In general, spontaneous and progressive infiltration will occur at a process temperature of at least about 700° C., and preferably of at least about 800° C. Temperatures generally in excess of 1200° C. do not appear to benefit the process, and a particularly useful temperature range has been found to be about from 800° to 1200° C.

In the present method, molten aluminum alloy is delivered to a mass of permeable ceramic material in the presence of a nitrogen-containing gas maintained for the entire time required to achieve infiltration. This is accomplished by maintaining a continuous flow of gas into contact with the lay-up of ceramic material and molten aluminum alloy. Although the flow rate of the nitrogen-containing gas is not critical, it is preferred that the flow rate be sufficient to compensate for any nitrogen lost from the atmosphere due to nitride formation in the alloy matrix, and also to prevent or inhibit the incursion of air which can have an oxidizing effect on the molten metal.

As stated above, the nitrogen-containing gas comprises at least about 10 volume percent nitrogen. It has been found that the nitrogen concentration can affect the rate of infiltration. More particularly, the time periods required to achieve infiltration tend to increase as the nitrogen concentration decreases. As is shown in Table I (below) for Examples 5–7, the time required to infiltrate alumina with molten aluminum alloy containing 5% magnesium and 5% silicon at 1000° C. increased as the concentration of nitrogen decreased. Infiltration was accomplished in five hours using a gas comprising 50 volume percent nitrogen. This time period increased to 24 hours with a gas comprising 30 volume percent nitrogen, and to 72 hours with a gas comprising 10 volume percent nitrogen. Preferably, the gas comprises essentially 100% nitrogen. Nitrogen concentrations at the lower end of the effective range, i.e. less than about 30 volume percent, generally are not preferred owing to the longer heating times required to achieve infiltration.

The method of this invention is applicable to a wide variety of ceramic materials, and the choice of filler material will depend on such factors as the aluminum alloy, the process conditions, the reactivity of the molten aluminum with the filler material, and the properties sought for the final composite product. These materials include (a) oxides, e.g. alumina, magnesia, titania, zirconia and hafnia; (b) carbides, e.g. silicon carbide and titanium carbide; (c) borides, e.g. titanium diboride, aluminum dodecaboride, and (d) nitrides, e.g. aluminum nitride, silicon nitride, and zirconium nitride. If there is a tendency for the filler material to react with the molten aluminum alloy, this might be accommodated by minimizing the infiltration time and temperature or by providing a non-reactive coating on the filler. The filler material may comprise a substrate, such as carbon or other non-ceramic material, bearing a ceramic coating to protect the substrate from attack or degradation. Suitable ceramic coatings include the oxides, carbides, borides and nitrides. Ceramics which are preferred for use in the present method include alumina and silicon carbide in the form of particles, platelets, whiskers and fibers. The fibers can be discontinuous (in chopped form) or in the form of continuous filament, such as multifilament tows. Further, the ceramic mass or preform may be homogeneous or heterogeneous.

Silicon carbide reacts with molten aluminum to form aluminum carbide, and if silicon carbide is used as the filler material, it is desirable to prevent or minimize this reaction. Aluminum carbide is susceptible to attack by moisture, which potentially weakens the composite. Consequently, to minimize or prevent this reaction, the silicon carbide is prefired in air to form a reactive silica coating thereon, or the aluminum alloy is further alloyed with silicon, or both. In either case, the effect is to increase the silicon content in the alloy to eliminate the aluminum carbide formation. Similar methods can be used to prevent undesirable reactions with other filler materials.

The size and shape of the ceramic material can be any size and shape which may be required to achieve the properties desired in the composite. Thus, the material may be in the form of particles, whiskers, platelets or fibers since infiltration is not restricted by the shape of the filler material. Other shapes such as spheres, tubules, pellets, refractory fiber cloth, and the like may be employed. In addition, the size of the material does not limit infiltration, although a higher temperature or longer time period may be needed for complete infiltration of a mass of smaller particles than for larger particles. Further, the mass of ceramic material to be infiltrated is permeable, i.e., permeable to molten aluminum alloys and to nitrogen-containing gases. The ceramic material can be either at its pour density or compressed to a modest density.

The method of the present invention, not being dependent on the use of pressure to force molten metal into a mass of ceramic material, allows the production of substantially uniform aluminum alloy matrix composites having a high volume fraction of ceramic material and low porosity. Higher volume fractions of ceramic material may be achieved by using a lower porosity initial mass of ceramic material. Higher volume fractions also may be achieved if the ceramic mass is compacted under pressure provided that the mass is not converted into either a compact with closed cell porosity or into a fully dense structure that would prevent infiltration by the molten alloy.

It has been observed that for aluminum infiltration and matrix formation with a given aluminum alloy/ceramic system, wetting of the ceramic by the aluminum alloy is the predominant infiltration mechanism. At low processing temperatures, a negligible or minimal amount of metal nitriding occurs resulting in a minimal discontinuous phase of aluminum nitride dispersed in the metal matrix. As the upper end of the temperature range is approached, nitridation of the metal is more likely to occur. Thus, the amount of the nitride phase in the metal matrix can be controlled by varying the processing temperature. The process temperature at which nitride formation becomes more pronounced also varies with such factors as the aluminum alloy used and its quantity relative to the volume of filler, the ceramic material to be infiltrated, and the nitrogen concentration of the gas used. For example, the extent of aluminum nitride formation at a given process temperature is believed to increase as the ability of the alloy to wet the ceramic filler decreases and as the nitrogen concentration of the gas increases. In any event the discontinuous aluminum nitride phase is present in at least two separately identifiable and physically distinct forms: (1) a coating or surface layer covering at least a portion of the ceramic filler; and (2) discrete, discontinuous bodies contacted by only the aluminum matrix metal.

It is therefore possible to tailor the constituency of the metal matrix during formation of the composite to impart certain characteristics to the resulting product. For a given system, the process temperature can be selected to control the nitride formation. A composite product containing an aluminum nitride phase will exhibit certain properties which can be favorable to, or improve the performance of, the product. Further, the temperature range for spontaneous infiltration with aluminum alloy may vary with the ceramic material used. In the case of alumina as the filler material, the temperature for infiltration should preferably not exceed about 1000° C. in order to insure that the ductility of the matrix is not reduced by the significant formation of any nitride. However, temperatures exceeding 1000° C. may be employed if it is desired to produce a composite with a less ductile and stiffer matrix. To infiltrate other ceramics such as silicon carbide, higher temperatures of about 1200° C. may be employed since the aluminum alloy nitrides to a lesser extent, relative to the use of alumina as filler, when silicon carbide is employed as a filler material.

In accordance with another embodiment of the invention, the composite is provided with an aluminum nitride skin or surface. Generally, the amount of the alloy is sufficient to infiltrate essentially the entire bed of ceramic material, that is, to the defined boundaries. However, if the supply of molten alloy becomes depleted before the entire bed or preform has been infiltrated, and the temperature has not been reduced to solidify the alloy, an aluminum nitride layer or zone may form on or along the outer surface of the composite due to nitriding of the surface regions of the infiltrating front of aluminum alloy. That portion of the bed not embedded by the matrix is readily removed as by grit blasting. Also, a nitride skin can be formed at the surface of the bed or preform infiltrated to its boundary by prolonging the process conditions. For example, an open vessel which is nonwettable by the molten aluminum alloy is filled with the permeable ceramic filler, and the top surface of the ceramic bed is exposed to the nitrogen gas. Upon metal infiltration of the bed to the vessel walls and top surface, if the temperature and flow of nitrogen gas are continued, the molten aluminum at the exposed surface will nitride. The degree of nitridation can be controlled, and may be formed as either a continuous phase or a discontinuous phase in the skin layer. It therefore is possible to tailor the composite for specific applications by controlling the extent of nitride formation on the surface of the composite. For example, aluminum matrix composites bearing a surface layer of aluminum nitride may be produced exhibiting improved wear resistance relative to the metal matrix.

As is shown in the following examples, molten aluminum-magnesium alloys spontaneously infiltrate the permeable mass of ceramic material due to their tendency to wet a ceramic material permeated with nitrogen gas. Auxiliary alloying elements such as silicon and zinc may be included in the aluminum alloys to permit the use of lower temperatures and lower magnesium concentrations. Aluminum-magnesium alloys which include 10–20% or more of silicon therein are preferred for infiltrating unfired silicon carbide since silicon tends to minimize reaction of the molten alloy with silicon carbide to form aluminum carbide. In addition, the aluminum alloys employed in the invention may include various other alloying elements to provide specifically desired mechanical and physical properties in the alloy matrix. For example, copper additives may be included in the alloy to provide a matrix which may be heat treated to increase hardness and strength.

EXAMPLES 1–10

These examples illustrate forming aluminum alloy matrix composites using various combinations of aluminum-magnesium alloys, alumina, nitrogen-containing gases, and temperature-time conditions. The specific combinations are shown in Table 1, below.

In Examples 1–9, molten Al—Mg alloys containing at least 1% by weight magnesium, and one or more auxiliary alloying elements, were delivered to the surface of a permeable mass of loose alumina particles, by contacting a solid body of the alloy with the alumina mass. The alumina particles were contained in a refractory boat at pour density. The size of the alloy body was 2.5×5×1.3 cm. The alloy-ceramic assembly was then heated in a furnace in the presence of a nitrogen-containing gas flowing at the rate of 200–300 cubic centimeters per minute. Under the conditions of Table 1, the molten alloy spontaneously infiltrated the bed of alumina material, with the exception of Example 2 where partial infiltration occurred It was found that alloy bodies weighing 43–45 grams were usually sufficient to completely infiltrate ceramic masses of 30–40 grams.

During infiltration of the alumina filler, aluminum nitride may form in the matrix alloy, as explained above. The extent of formation of aluminum nitride can be determined by the percent weight gain of the alloy, i.e., the increase in weight of the alloy relative to the amount of alloy used to effect infiltration. Weight loss can also occur due to volatilization of the magnesium or zinc which is largely a function of time and temperature. Such volatilization effects were not measured directly and the nitridation measurements did not take this factor into account. The theoretical percent weight gain can be as high as 52, based on the complete conversion of aluminum to aluminum nitride. Using this standard, nitride formation in the aluminum alloy matrix was found to increase with increasing temperature. For instance, the percent weight gain of 5 Mg–10 Si alloy of Example 8 (in Table I, below) was 10.7% at 1000° C., but when substantially this same experiment (not shown in Table I) was repeated except at 900° C., the percent weight gain was 3.4%. Similar results are also reported for Example 14, below. It therefore is possible to preselect or tailor the composition of the matrix, and hence the properties of the composite, by operating within certain temperature intervals.

In addition to infiltrating permeable bodies of ceramic particulate material to form composites, it is possible to produce composites by infiltrating fabrics of fibrous material. As shown in Example 10, a cylinder of Al–3% Mg alloy measuring 2.2 cm in length and 2.5 cm in diameter and weighing 29 grams was wrapped in a fabric made of du Pont FP alumina fiber and weighing 3.27 grams. The alloy-fabric assembly was then heated in the presence of forming gas. Under these conditions, the alloy spontaneously infiltrated the alumina fabric to yield a composite product.

Without intending to be bound by any specific theory or explanation, it appears that the nitrogen atmosphere induces spontaneous infiltration of the alloy into the mass of ceramic material. To determine the importance of nitrogen, a control experiment was done in which a nitrogen-free gas was employed. As shown in Table I, Control Experiment No. 1 was conducted in the same manner as Example 8 except for use of a nitrogen-free gas. Under these conditions, it was found that the molten aluminum alloy did not infiltrate the alumina bedding.

Analysis of scanning electron microscope images of some of the aluminum alloy matrix composites was done to determine the volume fractions of ceramic filler, alloy matrix and porosity in the composite. The results indicated that the volume ratio of ceramic filler to alloy matrix is typically greater than about 1:1. For instance, in the case of Example 3 it was found that the composite contained 60% alumina, 39.7% metal alloy matrix and a 0.3% porosity, by volume.

The photomicrograph of FIG. 1 is for a composite made substantially according to Example 3. Alumina particles 10 are seen embedded in a matrix 12 of the aluminum alloy. As can be seen by inspection of the phase boundaries, there is intimate contact between the alumina particles and the matrix alloy. Minimal nitriding of the alloy matrix occurred during infiltration at 850° C. as will become evident by comparison with FIGS. 2 and 3. The amount of nitride in the metal matrix was confirmed by x-ray diffraction analysis which revealed major peaks for aluminum and alumina and only minor peaks for aluminum nitride.

The extent of nitriding for a given aluminum alloy-ceramic-nitriding gas system will increase with increasing temperature for a given time period. Thus, using the parameters that produced the composite of FIG. 1, except for a temperature of 900° C. and for a time of 24 hours, the extent of nitriding was found to increase significantly, as can be seen by reference to FIG. 2. This experiment will be regarded as Example 3a below. The greater extent of nitride formation, as shown by the dark gray areas 14, is readily apparent by comparison of FIG. 1 with FIG. 2.

It has been found that the properties of the composite can be tailored by the choice of type and size of filler and by the selection of process conditions. To demonstrate this capability, a composite was made with the alloy and process conditions employed in Example 3, except at 1000° C. for 24 hours and using a 90 mesh alumina filler rather than a 220 mesh filler. The densities and elastic moduli of this composite as Example 3b, and that of Example 3a are shown below;

| Example Number | Temp. (°C.) | Density (g/cc) | Young's Modulus (GPa) |
|---|---|---|---|
| 3a | 900 | 3.06 | 154 |
| 3b | 1000 | 3.13 | 184 |

Figure 2:
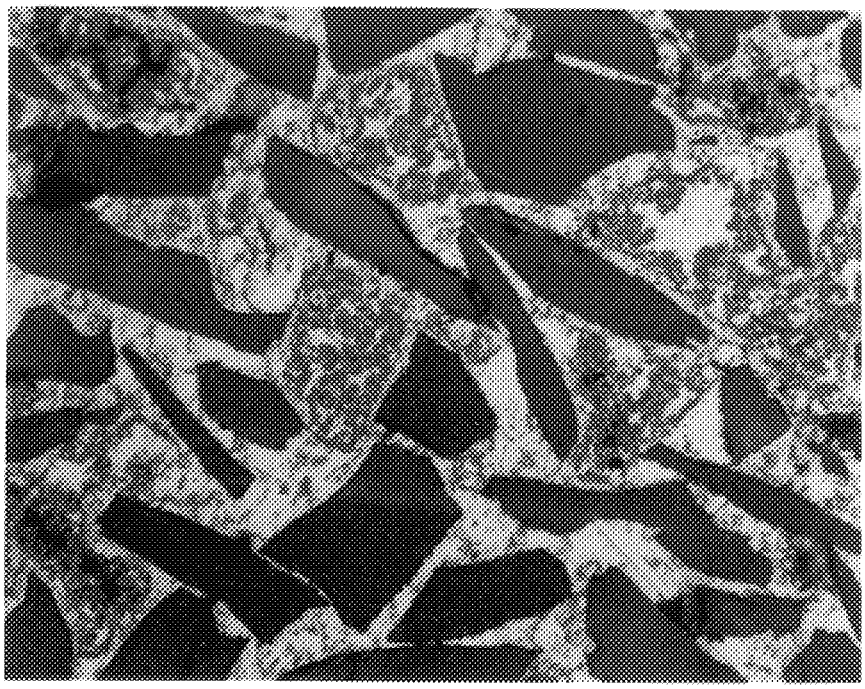
FIG. 2 is a photomicrograph taken at 400X magnification of an alumina-reinforced aluminum matrix composite produced substantially in accordance with Example 3a, but at a temperature of 900° C. for a time of 24 hours.
Figure 3:
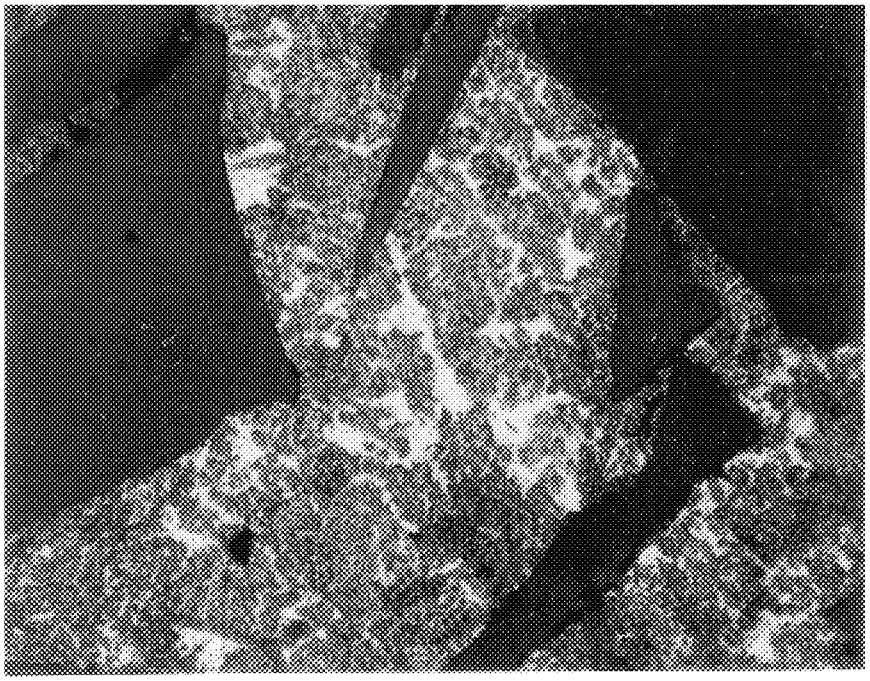
FIG. 3 is a photomicrograph taken at 400X magnification of an alumina-reinforced aluminum matrix composite (using somewhat coarser alumina particles, i.e 90 mesh size vs. 220 mesh size) produced substantially in accordance with Example 3b, but at a temperature of 1000° C. and for a time of 24 hours.

The results shown above illustrate that the choice of filler and process conditions may be used to modify the properties of the composite. In contrast to the results shown, the Young's Modulus for aluminum is 70 GPa. Also, a comparison of FIGS. 2 and 3 shows that a much higher concentration of AlN formed in Example 3b than in 3a. Although the size of the filler particles is different in the two examples, the higher AlN concentration is believed to be a result of the higher processing temperature and is regarded as the primary reason for the higher Young's Modulus of the composite of Example 3b (the Young's Modulus for AlN is 345 GPa).

TABLE I

ALUMINUM MATRIX-ALUMINA COMPOSITES

| Example No. | Control Expt. No. | Aluminum Alloy Composition[a] (%) | $Al_2O_3$ Particle Size | Gas Composition (%) | Infilt. Temp. (°C.) | Infilt. Time (hr) |
|---|---|---|---|---|---|---|
| 1 | | 3 Mg-5 Si | 220-mesh | Forming gas[b] | 1000 | 5 |
| 2 | | 1 Mg-5 Si | 220-mesh | Forming gas | 1000 | 5 |
| 3 | | 3 Mg-5 Si-6 Zn | 220-mesh | Forming gas | 850 | 18 |
| 4 | | 5 Mg-5 Si | 220-mesh | Forming gas | 900 | 5 |
| 5 | | 5 Mg-5 Si | 90-mesh | 50/50 $N_2$/Ar | 1000 | 5 |
| 6 | | 5 Mg-5 Si | 90-mesh | 30/70 $N_2$/Ar | 1000 | 24 |
| 7 | | 5 Mg-5 Si | 90-mesh | 10/90 $N_2$/Ar | 1000 | 72 |
| 8 | | 5 Mg-10 Si | 220-mesh | Forming gas | 1000 | 10 |
| 9 | | 5 Mg-10 Si | 220-mesh | $N_2$ | 1000 | 10 |
| 10 | | 3 Mg | Fabric | Forming gas | 1100–1200 | 2 |
| | 1 | 5 Mg-10 Si | 220-mesh | 96/4 Ar/$H_2$ | 1000 | 10 |

[a]Balance aluminum
[b]96% $N_2$/4% $H_2$

EXAMPLES 11–21

Ceramic materials other than alumina may be employed in the invention. As shown in Examples 11–21 of Table II, aluminum alloy matrix composites reinforced with silicon carbide may be produced. Various combinations of magnesium-containing aluminum alloys, silicon carbide reinforcing materials, nitrogen-containing gases, and temperature/time conditions may be employed to provide these composites. The procedure described in Examples 1–9 was followed with the exception that silicon carbide was substituted for alumina. Gas flow rates were 200–350 cc/min. Under the conditions set forth in Examples 11–21 of Table II, it was found that the alloy spontaneously infiltrated the mass of silicon carbide.

The volume ratios of silicon carbide to aluminum alloy in the composites produced by these examples were typically greater than 1:1. For example, image analysis (as described above) of the product of Example 13 indicated that the product comprised 57.4% silicon carbide, 40.5% metal (aluminum alloy and silicon) and 2.1% porosity, all by volume.

The magnesium content of the alloy employed to effect spontaneous infiltration is important. In this connection, experiments utilizing the conditions of Control Experiments 2 and 3 of Table II were performed to determine the effect of the absence of magnesium on the ability of aluminum alloys to spontaneously infiltrate silicon carbide. Under the conditions of these control experiments, it was found that spontaneous infiltration did not occur when magnesium was not included in the alloy.

The presence of nitrogen gas is also important. Accordingly, Control Experiment No. 4 was performed in which the conditions of Example 17 were employed except for use of a nitrogen-free gas, i.e., argon. Under these conditions, it was found that the molten alloy did not infiltrate the mass of silicon carbide.

As explained above, temperature can affect the extent of nitriding, as was illustrated by repeating Example 14 at five different temperatures. Table II, below, shows Example 14 conducted at 800° C., and the weight gain was 1.8%, but when the run was repeated at temperatures of 900°, 1000° and 1100° C., the weight gains were 2.5%, 2.8% and 3.5%, respectively, and there was a marked increase to 14.9% for a run conducted at 1200° C. It should be observed that the weight gains in these runs were lower than in the Examples employing an alumina filler.

Various materials other than alumina and silicon carbide may be employed as ceramic filler materials in the composites of the present invention. These materials, which include zirconia, aluminum nitride and titanium diboride are shown in Examples 22–24, respectively.

EXAMPLE 24

The procedure described in Example 23 was repeated with the exception that titanium diboride powder having a mean particle size of 5–6 microns (Grade HTC from Union Carbide Co.) was substituted for the aluminum nitride powder. Aluminum alloys of the same composition as in Example 23 spontaneously infiltrated the powder and formed a uniform metal matrix bonding the powder together, with minimal nitride formation in the alloy. Unit weight gains of 11.3% and 4.9% were obtained for Al–3 Mg and Al–3 Mg–10 Si alloys, respectively.

In comparison with conventional metal matrix composite technology, the invention obviates the need for high pressures or vacuums, provides for the production of aluminum matrix composites with a wide range of ceramic loadings and with low porosity, and further provides for composites having tailored properties.

TABLE II

ALUMINUM MATRIX-SILICON CARBIDE COMPOSITES

| Example No. | Control Expt. No. | Aluminum Alloy Composition | SiC Type | Gas Composition | Temp. (°C.) | Time (hr) |
|---|---|---|---|---|---|---|
| 11 | — | 3 Mg | 500-mesh particles[a,b] | Forming gas | 1000 | 24 |
| 12 | — | 3 Mg-10 Si | " | Forming gas | 1000 | 24 |
| | 2 | Pure Al | " | Forming gas | 1000 | 24 |
| | 3 | 10 Si | " | Forming gas | 1000 | 24 |
| 13 | — | 3 Mg-15 Si | 500-mesh particles[b] | Forming gas | 950 | 24 |
| 14 | — | 5 Mg-15 Si | 500-mesh particles[a,b] | Forming gas | 800 | 10 |
| 15 | — | 5 Mg-15 Si | 500-mesh particles[b] | Forming gas | 1000 | 10 |
| 16 | — | 5 Mg-15 Si | " | $N_2$ | 1000 | 10 |
| — | 4 | 5 Mg-15 Si | " | Argon | 1000 | 10 |
| 17 | — | 5 Mg-17 Si | " | Forming gas | 1000 | 10 |
| 18 | — | 1 Mg-3 Si | " | Forming gas | 1200 | 10 |
| 19 | — | 5 Mg-15 Si | Loose SiC fibers[c] 5.6 mils | Forming gas | 950 | 18 |
| 20 | — | 5 Mg-15 Si | SiC whiskers[d] | Forming gas | 850 | 24 |
| 21 | — | 5 Mg-15 Si | Chopped SiC fibers[e] | Forming gas | 900 | 24 |

[a]Prefired at 1250° C. for 24 hrs.
[b]39 Crystolon (99+% pure SiC - Norton Company)
[c]From Avco Specialty Materials Co.
[d]In a pressed preform placed on $ZrO_2$ bedding in $Al_2O_3$ boat, whiskers from Nippon Light Metals Co., Ltd.
[e]Nicalon fibers from Nippon Carbon Co., Ltd.

EXAMPLE 22

An aluminum alloy containing 5% magnesium and 10% silicon was melted in contact with the surface of a zirconia particle bedding (220 mesh, SCMg3 from Magnesium Elektron, Inc.) in an atmosphere of forming gas at 900° C. Under these conditions, the molten alloy spontaneously infiltrated the zirconia bedding, yielding a metal matrix composite.

EXAMPLE 23

The procedure described in Examples 1–9 was employed for two runs with the exception that aluminum nitride powder of less than 10 microns particle size (from Elektroschmelzwerk Kempton GmbH) was substituted for the alumina. The assembled alloy and bedding were heated in a nitrogen atmosphere at 1200° C. for 12 hours. The alloy spontaneously infiltrated the aluminum nitride bedding, yielding a metal matrix composite. As determined by percent weight gain measurements, minimal nitride formation, together with excellent infiltration and metal matrix formation, were achieved with 3 Mg and 3 Mg–10 Si alloys. Unit weight gains of only 9.5% and 6.9%, respectively, were found.

What is claimed is:

1. An aluminum matrix composite, comprising:

a three-dimensionally interconnected matrix metal comprising aluminum having embedded therein throughout its bulk (1) at least one ceramic filler material selected from the group consisting of oxides, carbides, borides, silicon nitride and zirconium nitride; and (2) aluminum nitride, said aluminum nitride having at least two separate and distinct forms comprising (i) discrete, discontinuous bodies contacting only said matrix metal and (ii) a surface layer coating at least a portion of said ceramic filler material.

2. The metal matrix composite body of claim 1, wherein said at least one ceramic filler material comprises a material selected from the group consisting of aluminum oxide, silicon carbide, titanium diboride and zirconium dioxide.

3. The metal matrix composite body of claim 1, wherein said matrix metal further comprises at least one alloying element selected from the group consisting of magnesium, iron, silicon, copper, manganese, zinc and chromium.

4. The metal matrix composite body of claim 1, wherein said at least one filler material comprises a form selected from the group consisting of particles, platelets, spheres, pellets, fibers, multifilament refractory cloth, tubules and whiskers.

5. The metal matrix composite body of claim 1, wherein said matrix metal further comprises magnesium.

6. A metal matrix composite body, comprising:

a matrix metal comprising aluminum having embedded therein throughout its bulk (1) a reinforcement phase comprising at least one filler material and consisting essentially of a plurality of discrete discontinuous bodies, wherein a volumetric ratio of said reinforcement phase to said matrix metal is greater than about one, further wherein said at least one filler material comprises a non-ceramic substrate coated with at least one ceramic material; and (2) aluminum nitride, said aluminum nitride having at least two separately identifiable and physically distinct forms, at least one of said forms comprising discrete discontinuous bodies each contacting only said matrix metal, and at least one other of said forms comprising a surface layer covering at least a portion of said filler material.

7. A macrocomposite, comprising:

a metal matrix composite body comprising a three-dimensionally interconnected matrix metal comprising aluminum having embedded therein throughout its bulk at least one filler material and aluminum nitride, wherein said at least one filler material comprises a member selected from the group consisting of an oxide, a carbide and a boride; and an external layer comprising continuous aluminum nitride disposed on said metal matrix composite body.

8. The macrocomposite of claim 7, wherein said filler material comprises a preform.

9. A metal matrix composite body, comprising:

a matrix metal comprising aluminum having embedded therein throughout its bulk (1) a reinforcement phase comprising at least one filler material selected from the group consisting of oxides, carbides and borides and which, but for said embedding matrix metal, would consist essentially of a loose mass of bodies; and:

(2) aluminum nitride, said aluminum nitride having at least two separately identifiable and physically distinct forms comprising (a) discrete discontinuous bodies each contacting only said matrix metal and (b) a surface layer covering at least a portion of said filler material.

10. The metal matrix composite body of claim 9, wherein said filler material comprises at least one material selected from the group consisting of silicon carbide and aluminum oxide.

11. The metal matrix composite body of claim 9, wherein said mass is homogeneous.

12. The metal matrix composite body of claim 9, wherein said mass is heterogeneous.

13. A metal matrix composite, comprising:

a body of matrix metal defining at least one external surface;

at least one filler material dispersed in said body of matrix metal;

aluminum nitride covering at least a portion of said filler material as a coating or surface layer; and a skin disposed on at least a portion of said at least one external surface of said body of matrix metal, said skin comprising aluminum nitride in continuous form.

14. The metal matrix composite of claim 13, wherein said skin consists essentially of said aluminum nitride and matrix metal.

15. The metal matrix composite of claim 13, wherein said at least one filler material comprises at least one material selected from the group consisting of oxides, carbides and borides.

16. The metal matrix composite of claim 13, wherein said at least one filler material comprises at least one material selected from the group consisting of silicon nitride and zirconium nitride.

* * * * *